US010835047B2

(12) United States Patent
Dimitrov

(10) Patent No.: US 10,835,047 B2
(45) Date of Patent: Nov. 17, 2020

(54) SOFA WALL BEDS

(71) Applicant: Specialised Construction Limited, London (GB)

(72) Inventor: Zdravko Tsvetanov Dimitrov, London (GB)

(73) Assignee: SPECIALISED CONSTRUCTION LIMITED, London (GB)

( * ) Notice: Subject to any disclaimer, the term of this patent is extended or adjusted under 35 U.S.C. 154(b) by 0 days.

(21) Appl. No.: 16/368,426

(22) Filed: Mar. 28, 2019

(65) Prior Publication Data

US 2020/0305612 A1 Oct. 1, 2020

(51) Int. Cl.
*A47C 17/46* (2006.01)
*A47C 17/86* (2006.01)

(52) U.S. Cl.
CPC ..... *A47C 17/46* (2013.01); *A47C 17/86* (2013.01)

(58) Field of Classification Search
CPC ..... A47C 17/38; A47C 17/46; A47C 17/86; A47C 17/48; A47C 17/58; A47C 17/70; A47C 17/16; A47C 17/165; A47C 17/13; A47C 17/18; A47C 17/12
See application file for complete search history.

(56) References Cited

U.S. PATENT DOCUMENTS

2003/0121099 A1* 7/2003 Lim ..... A47C 17/48 5/136
2011/0023230 A1* 2/2011 Colombo ..... A47C 17/38 5/43
2013/0025049 A1* 1/2013 McCoy ..... A47C 17/48 5/133
2014/0047638 A1* 2/2014 Zimmer ..... A47C 17/62 5/2.1
2015/0067963 A1* 3/2015 Grimoldi ..... A47C 17/165 5/37.1
2016/0074698 A1* 3/2016 Figueroa ..... A47C 17/38 5/2.1
2017/0226754 A1* 8/2017 Gosling ..... A47C 17/38
2018/0303242 A1* 10/2018 Nitori ..... A47C 17/136
2019/0167008 A1* 6/2019 Grossman ..... A47C 17/54
2020/0170415 A1* 6/2020 Broussard ..... A47C 19/22

FOREIGN PATENT DOCUMENTS

EP 2363044 A1 * 9/2011 ..... A47C 17/52

* cited by examiner

*Primary Examiner* — Nicholas F Polito
*Assistant Examiner* — George Sun
(74) *Attorney, Agent, or Firm* — Sinorica, LLC

(57) ABSTRACT

A sofa bed assembly comprises a carcass having an inside, outside and interstitial interface. Mechanical moving parts comprise a bed base mount assembly and gas strut all outside the carcass and interface mounted. A base supports a mattress held by base sidewalls, vertical within and filling the carcass with the sofa bed closed. An armrest supports a sitter's arm in the closed assembly and as is a proximal bed support in the open assembly. Pivoted leg supports at the end of the bed base rotate as distal bed supports. Alternatively, a sofa is moved to the end of the bed base as distal bed support. An armrest extension extends the armrest for the closed assembly and folds through 90° for the open assembly allowing the armrest to act as the proximal bed support. Armrest shields cover mechanical moving parts.

8 Claims, 7 Drawing Sheets

SOFA WALL BEDS

FIELD OF THE INVENTION

The present invention relates to a wall beds. Wall beds are beds which fold up against a wall when not in use and which fold down for a mattress to be supported above the floor of the room in which the wall bed is to be used.

Many different types of wall beds are known.

One class involves providing a wall bed to fold up against a storage wall into a wardrobe the doors of which can be closed to conceal the wall bed when the bed is stowed away after use. The present invention does not relate to wardrobe wall beds.

Another class involves providing a sofa at the base of the wall bed when the wall bed is stowed against the wall where it is attached. When the sofa wall bed is stowed away, the sofa is positioned at the bottom of the stowed sofa wall bed and is available for persons or other items to sit or rest thereon. When the sofa wall bed is lowered for use in sleeping, the sofa is transformed by rotation of a bed baseboard to allow the bed portion to swing parallel to the floor and to be supported at its distal end thereby allowing a person to lie upon the bed portion.

The present invention relates to sofa wall beds.

BACKGROUND TO THE INVENTION

The prior art relating to sofa beds includes United States patent application US2015067963 that discloses a piece of furniture, convertible from sofa use to bed use and vice versa, having a framework that supports a bed member that can be tilted onto a sofa member in a day position, in which the bed member is vertical and the sofa member can be used for sitting, and a night position, in which the bed member is horizontal and surmounts the sofa member. The piece of furniture includes an articulated system that connects the bed member to the sofa and to the framework. The bed member forms a lying surface in the night position, while the sofa member forms a sitting surface in the day position. The lying surface of the bed member substantially corresponds to the sitting surface of the sofa member. The sofa member forms, in the night position, a retracted surface different from the sitting surface. US 2015067963 offers a solution incapable of supporting a full-size bed and provides limited bed accommodation. The present invention seeks to provide improvement there over by offering a solution where bed accommodation after the largest size can be provided.

Prior art related to sofa beds also includes French patent FR2793665 that discloses a tilting mechanism of a couch assembly and a bed that can move between a first configuration wherein the couch is operable while the bed is retracted, and a second position wherein the bed is then used as the couch is retracted. The tilting mechanism comprises at least one plate that is articulated about a fixed axis and supporting a beam of the bed The mechanism also comprises control means for the pivot platen about its articulation axis. The mechanism yet further comprises a lever, articulated on the plate and a control means, the lever being also hinged on a first end and a connecting rod whose second end is articulated about a fixed axis. FR2793665 provides a complex mechanism that is difficult to assemble. The present invention seeks to provide improvement there over by offering a much simplified mechanism that is readily and simply assembled.

Sofa bed prior art further includes Russian patent application RU2014117503 that discloses a furniture item comprising a bed that can be lowered by rotation around a horizontal rotation axis, a part for sitting on comprising a movable seat and a back fixed to the bed, and a mechanism adapted to horizontally move away the seat from the axis, when the bed is lowered, at least by a distance equal to the horizontal length of the lowered back. In this manner the part for sitting on splits ands flattens a lot, thereby leaving a lot of stroke to the bed to lower to a comfortable height. RU 2014117503 is like US 2015067963 by offering a solution incapable of supporting a four-sized bed and thereby provides limited accommodation. RU2014117503 also provides a mechanism that is needlessly complex and difficult to assemble. The present invention seeks to provide improvement there over by offering use of a bed up to the largest dimensional's and further seeks to improve there over by allowing for simplified and direct assembly.

In general, the prior art requires quite complex, mechanisms where specially designed parts are needed. The present invention seeks to provide a simple mechanism employing the only readily available "off-the-shelf" parts.

The complex mechanisms general in the prior art have bigger chance to fail. Extremely high forces exerted on the pivoting points in prior art designs also reduces the reliability. The present invention seeks to provide a simplified mechanism where only low stresses exist.

SUMMARY OF THE INVENTION

The present invention consists in a sofa bed comprising:

a carcass having first and second sidewalls and top and bottom panels, the carcass providing an inside and an outside, and also providing an interface between the inside and the outside;

a bed base, rotatable to lie coplanar with the interface when the bed is in the closed position and at a right angle to the interface coplanar with a floor when the bed is in an open position;

a sofa base and a sofa back disposed to enable a person to sit thereon when the bed is in a closed position and foldable against one another beneath the bed base when the bed is in an open position;

where the bed base comprises an armrest for a seated person to rest their arm when the bed is in a closed position and where the armrest acts as a proximal bed support at the end of the bed base closest to the carcass when the bed is in the open position;

and where the sofa bed comprises a distal bed support for the bed base at the end of the bed base furthest from the carcass, the distal bed support being transformable to a support function as the bed base is moved to an open position.

The invention also provides that the sofa bed can comprise a shelf, rotatable under gravity to act as the distal support.

The invention also provides that the sofa bed can also comprise a sofa base, movable from its position as a component of the sofa as the bed is lowered into the open position to position where the sofa base is operable to act as said distal support.

The invention further provides that the sofa bed can also comprise first and second horizontally spaced rotatable mount assemblies operable to support the bed base for rotation between a vertical and a horizontal position, the first and second mount assemblies being attached to the outside of the carcass at the interface.

The invention further provides that the sofa bed can comprise a gas strut fixable at a first end to the armrest and at a second end to the interface proximate to a floor, the gas strut lying outside of the carcass, such that the gas strut is uncompressed when the bed is in the closed position and impressed when the bed is in the open position.

For the avoidance of confusion, it is to be understood in the description, claims and drawings herein before and herein after of this application that the gas struts are defined as gas struts alone, and/or as gas struts interchangeable with and used together with linear actuators which can be powered to alter their length for operation of the sofa bed assembly.

The invention further provides that the armrest can be provided with a rotatable armrest extension, that rotates as the bed is raised into the closed position to provide an extension to the armrest for use by a person sitting upon the sofa; the armrest extension being operable as the bed is lowered to the open position to engage the floor to swing at 90° to the armrest to allow the armrest to act as said proximal support.

The invention further provides that the sofa bed can comprise an armrest shield for each armrest, each armrest shield covering tits respective armrest, its mount assembly and its respective gas strut and able to accommodate movement thereof there within as the bed base moves between a vertical closed position to a horizontal open position.

The invention further provides that the sofa bed can further comprise a mattress and bed face sidewalls; the bed base sidewalls being co-operative to hold the mattress atop the bed base when the sofa bed is in the open position; and co-operative to hold the mattress, when the bed base is in the closed vertical position, within the carcass.

The invention also provides that the sofa bed can comprise one or more storage locations within the carcass.

BRIEF DESCRIPTION OF THE DRAWINGS

The invention is described, by way of example, by the following detailed description to be read in conjunction with the appended drawings, in which.

And

Figure 6:
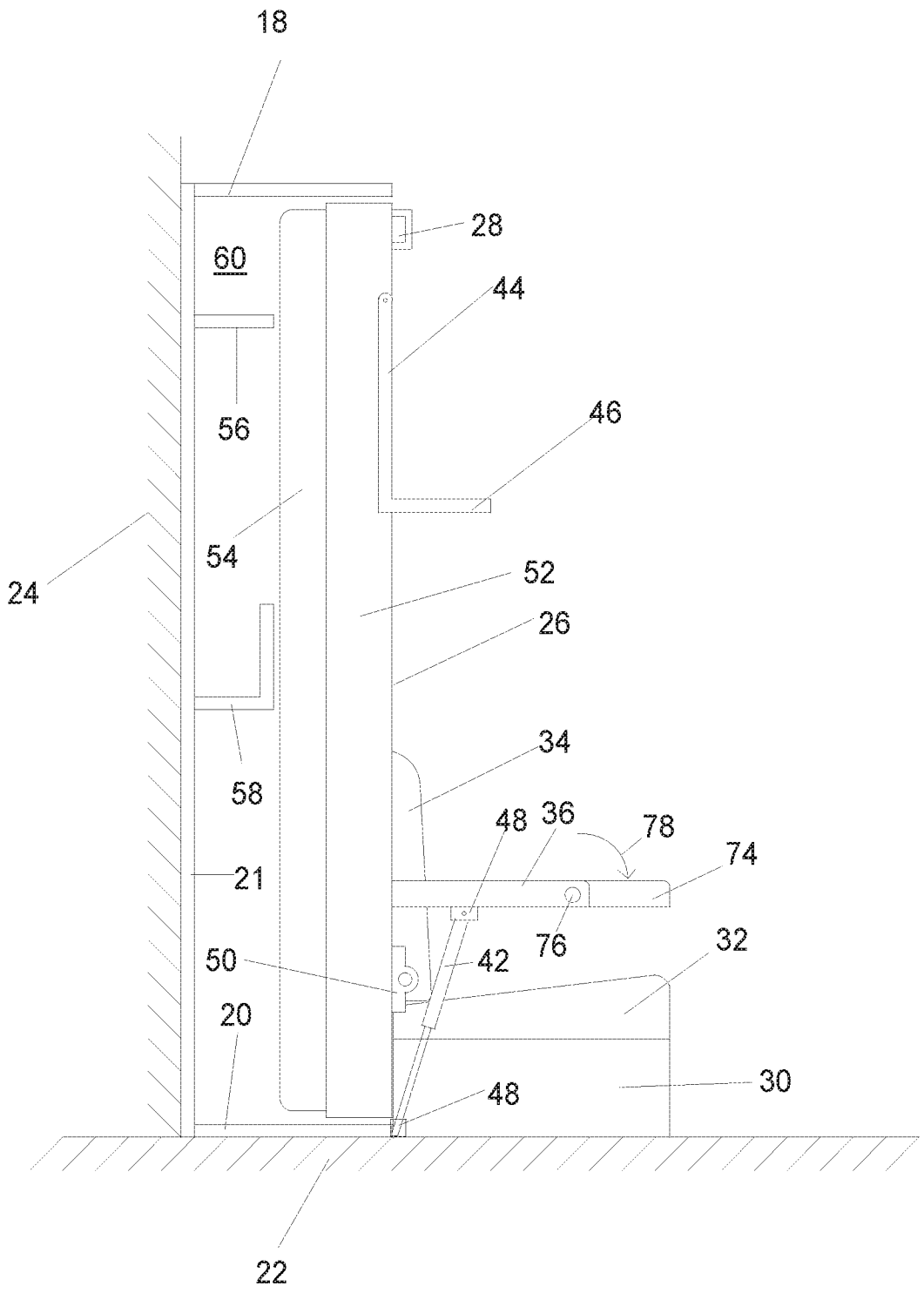
FIG. 6 shows the sofa bed of FIG. 2 in a closed position with an improved armrest.
Figure 7:
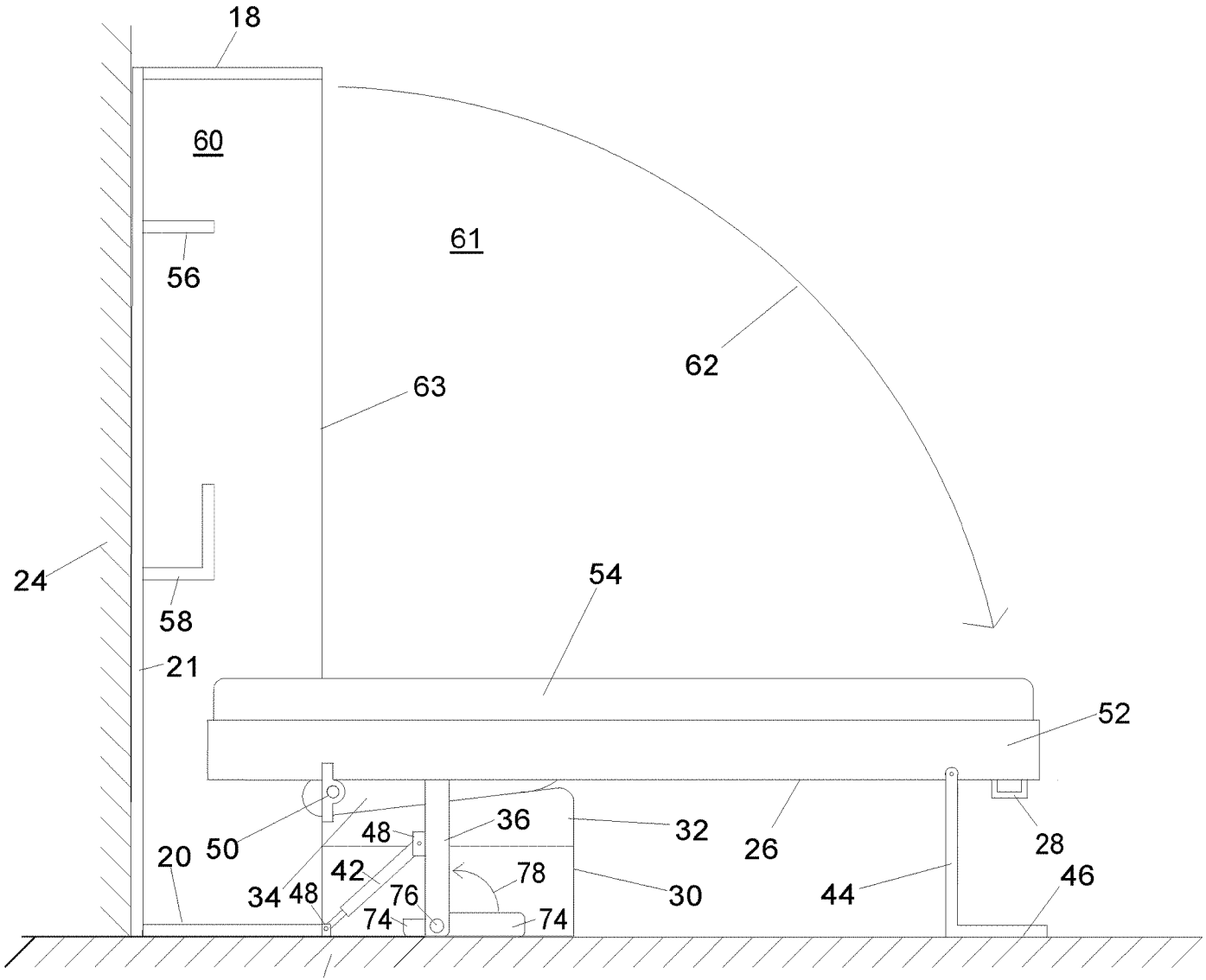

FIG. 7 shows the sofa bed of FIG. 6 in an open position.

DETAILED DESCRIPTION

Figure 1:
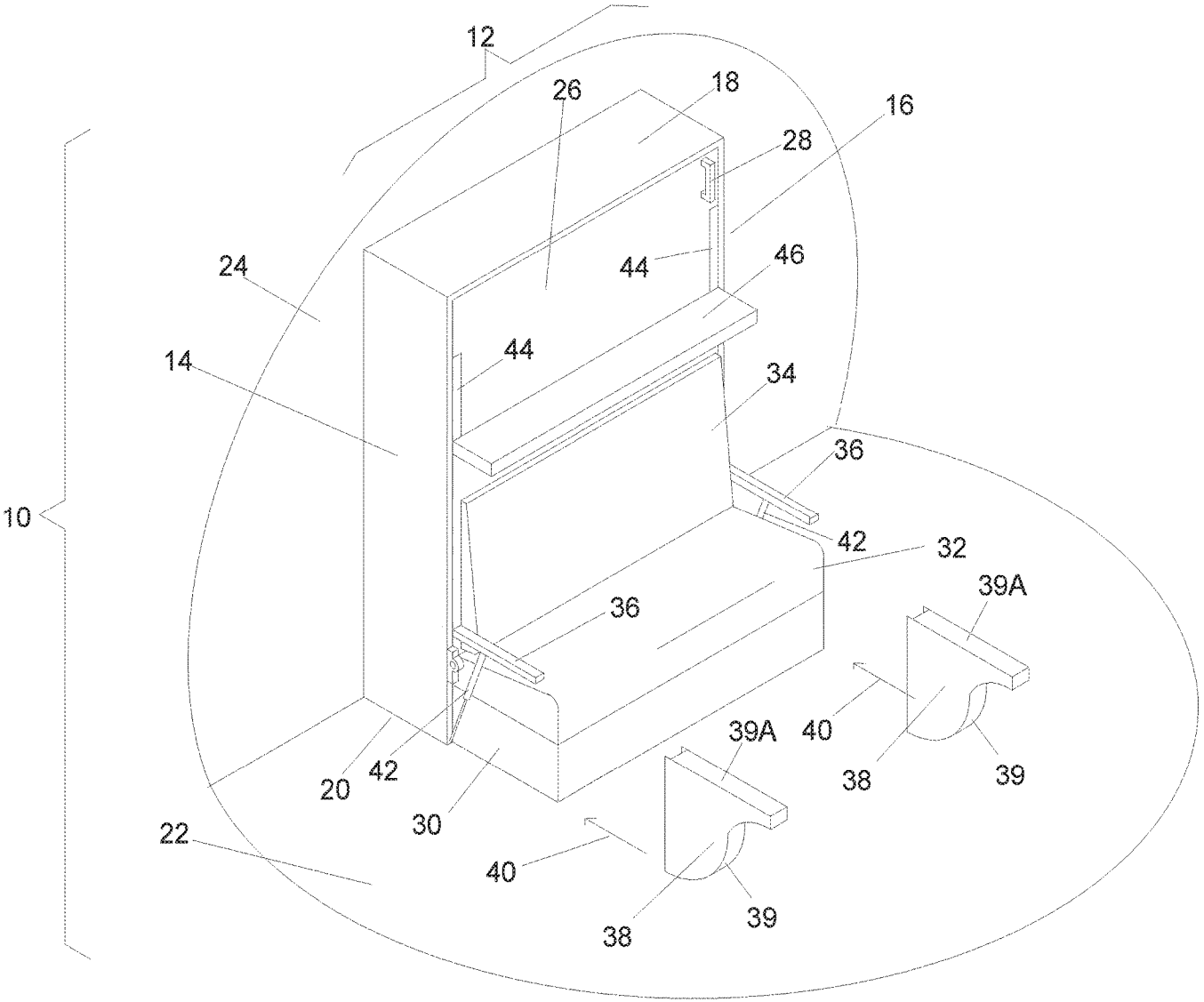
FIG. 1 shows an oblique view of the invention when in the closed position

Attention is first drawn to FIG. 1, an oblique view of the invention when in the closed position. For avoidance of doubt, the closed position is here defined as that position where a bed is put away and a sofa is provided, and the open position is here defined as that position where the sofa is no longer usable and the bed is enabled for use. It is to be understood that the open position and the closed position can be cycled between.

A sofa bed assembly 10 comprises a carcass 12 having at least first 14 and second 16 side walls and top 18 and bottom 20 panels. The second side wall 16 and the bottom panel 20 are obscured in FIG. 1. The carcass 12 can also comprise a back panel 21 (shown in FIG. 2)). The sofa bed assembly 10 stands on a floor 22 against a wall 24, and resembles in its placement a wardrobe (from which the doors are missing). The carcass 12 is preferably secured to the wall 24.

Instead of doors, the carcass 12 has a bed base 26 that, in the closed position view of FIG. 1, substantially fills the space that would have been occupied by doors had the carcass 12 been for a wardrobe. A hand grip 28 and/or a shelf 46 (also shown in FIG. 1) permits a user to grasp the bed base 26 for rotation there of when the sofa bed assembly 10 is to be moved to the open position, to be shown hereafter.

The sofa bed assembly 10, shown in FIG. 1 in the closed position, has a sofa comprising a sofa base 30 that sits upon the floor 22, a sofa cushion 32 that sits upon the sofa base 30, and A sofa back 34 that is affixed to the bed base 26. The sofa base 30 sits upon the floor 22 beneath the attachment point of the sofa back 34. The sofa base 30 is preferably made in the form of a hollow box where in articles can be stored. The sofa base can optionally be provided with wheels or casters allowing it to be moved upon the floor 22. With the sofa bed assembly 10 in the closed position shown in FIG. 1, a person can sits upon the sofa cushion 32 and may lean against the sofa back 34.

Armrests 36 are provided on either edge side of the bed base 26, affixed to the bed base 26 at right angles there to, enabling a person, sitting on the sofa 30 32, 34, to rest their arms there on. Arm rests shields 38 each comprise an arcuate lower outer profile 39 and an armrest cover 39A, The armrest shields 39 are movable as indicated by arrows 40 to cover the armrests 36 and also protect against mechanical entrapment by the movement and compression of gas struts 42 when the sofa bed assembly 10 is moved to the open position. The armrest covers armrest covers 39A are affixed to the armrests 36 to be rotational therewith. The arcuate lower outer profile 39 clears the floor 22 as the bed assembly 10 moves from a bed-open to bed-closed position and back again, The armrest shields 38 are hollow and allow the movement of the armrests 36 and gas struts 42 to take place as the sofa bed assembly 10 is opened and closed while all the time shielded and concealed. Optionally, the armrest shields 38 may be upholstered to be in keeping with the appearance of the sofa 30, 32, 34.

Leg supports 44 are set within opposite sides of the bed base 26 and pivoted at their top ends onto the bed base 26 to maintain a vertical position as the bed base 26 rotates towards horizontal as the sofa bed assembly 10 moves to the open position (shown hereafter). A shelf 46 is attached between the distal ends of the leg supports 44 to add weight to ensure the leg supports 44 swing to the vertical position as the bed base 26 rotates. Optionally, ornaments and other items can be placed upon the shelf 46, since, as will be shown, the shelf 46 maintains an upright vertical position until the leg supports 44 rest upon the floor with the still-horizontal shelf 46 also resting thereon.

Figure 2:
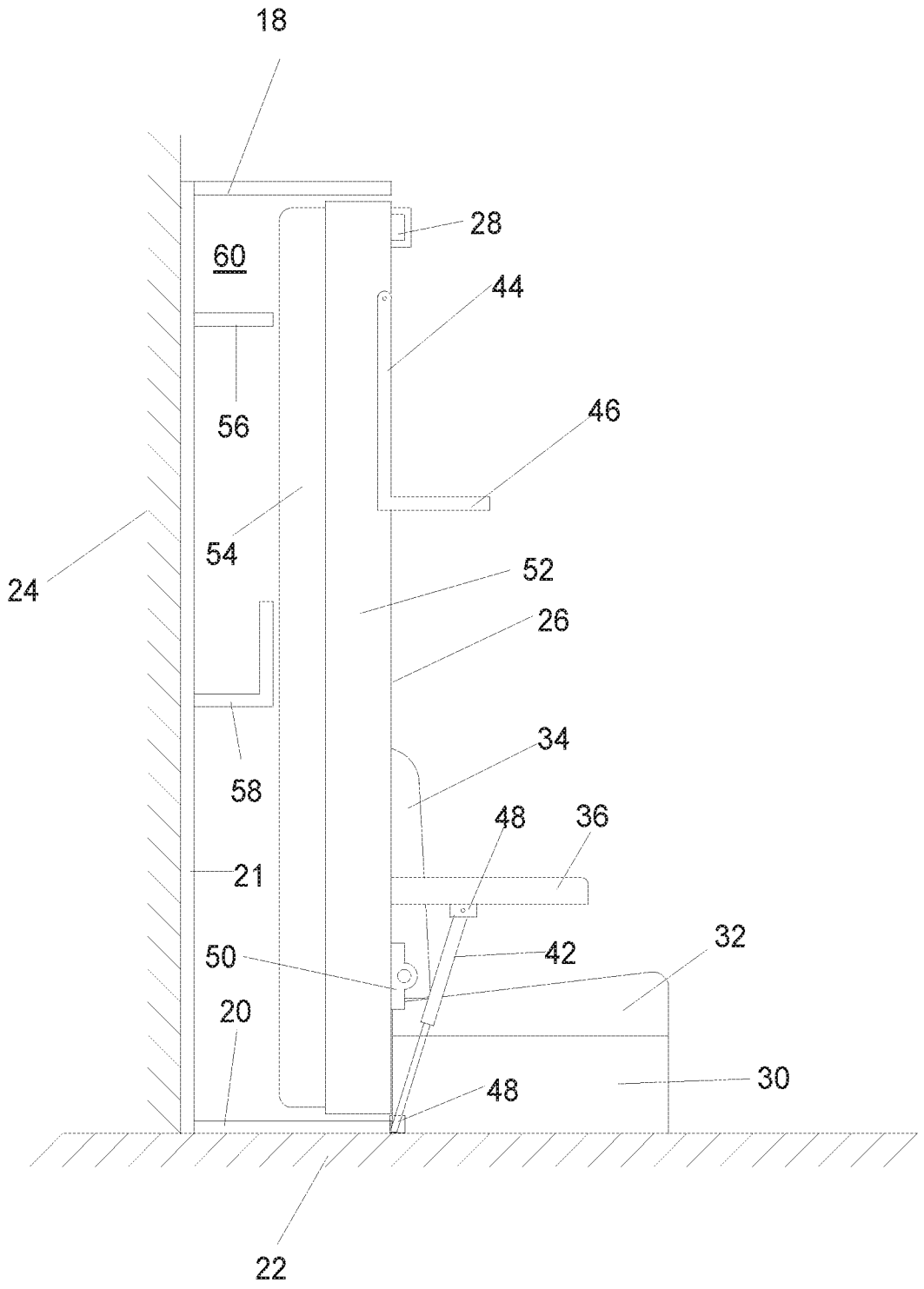
FIG. 2 shows a side view of the closed sofa bed assembly looking in the direction of the first sidewall FIG. 3 show is the view of FIG. 2, but now moved to the open position where the bed is ready for use according to a first embodiment of the sofa bed.

Attention is next drawn to FIG. 2, a side view of the sofa bed assembly 10 of FIG. 1 looking in the direction of the first sidewall 14 (shown in FIG. 1). Like items in FIGS. 1 and 2 have liked numbers. For the purpose of expositional clarity, to reveal the inside of the carcass 12, the first sidewall 14 has been omitted. It is to be understood that, structurally, the first sidewall 14 is present though not shown. The arm rest shields 38 are also omitted more clearly to see the elements present. It is to be understood that, in normal use, the armrest shields 38 are present.

The ends of the gas struts 42 are pivotably mounted in gas strut brackets 48 provided beneath the armrests 36 and at the very edge of the baseboard 21 furthest from the wall 24 and in line with the bed base sidewalls 52. The pivotal brackets 48 allow the gas struts 42 to exhibit rotational movement as the sofa bed assembly 10 moves from the closed to the open position and vice versa. It is a feature of the present invention that the gas struts 42 are in an extended condition when installed between the very edge of the baseboard 21 and the underside of the armrests 36. This arrangement, as shown in FIG. 2, makes for ease of assembly by completely removing pressure that needs to be applied to the gas struts 42 when the gas struts 42 are first installed or replaced later (the struts are virtually free when the bed is lifted. The bed is kept in closed position by the gravity). As will later be seen, the gas struts 42, when the bed is opened, are compressed to a close condition under mechanical leverage from the assembled sofa bed 10.

A rotational bearing assembly 50, as will later be shown, is mounted respectively at each side of the bed base 26 on respectively the edges away from the wall 24 of the first 14 and second 16 sidewalls to allow the bed base 26 to rotate relative to the carcass 12 thereby permitting movement from the close to the open position and vice versa.

The bed base 26 is surrounded on all four sides my bed base sidewalls 52 that support and retain a mattress 54 even when the bed base 26 is vertical as in the closed position. Preferably the mattress is sufficiently compliant that any bedclothes are also retained in a "made bed" condition so that a user if is merely to move the sofa bed assembly 10 to the open position to be ready to sleep.

One or more storage shelves 56 and/or storage receptacles 58 may be provided on the inside 60 of the carcass 12 behind the retained mattress 54 permitting local retention of such items as pillows and night attire when the sofa bed assembly 12 is in the closed position.

The inside 60 of the carcass 12, is in contrast to the outside 61 of the carcass. As will become clear, the mechanical parts involved in the movement of the sofa bed assembly 10 are installed and assembled entirely on the outside 61 of the carcass 12 and function entirely on the outside 61 thereby avoiding cramped functioning within the carcass 60. The mechanical parts 50 42, in assembly, are attached to the sofa bed assembly only at the interface 63 between the inside 60 and the outside 61 which is to be found at the very edge of the first sidewall 14 remote from the back panel 21 and at the very edge of the second sidewall 16 remote from the back panel 21. Such an arrangement allows for simplicity and ease of construction not found in other designs.

Figure 3:
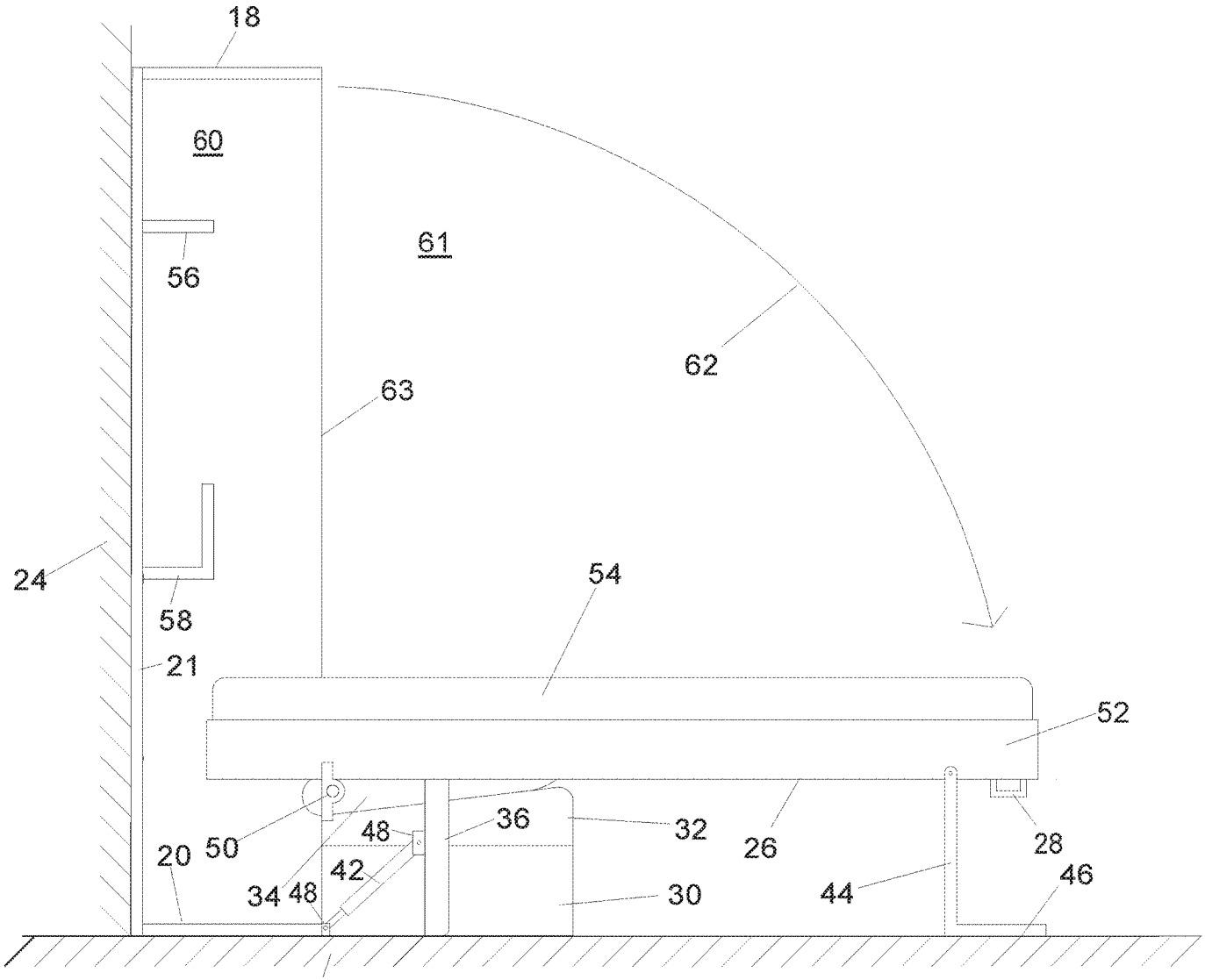

Attention is next drawn to FIG. 3, showing the view of FIG. 2, but now moved to the open position where the bed 26 52 54 is ready for use, according to a first embodiment of the invention. Similar items have similar numbers in FIG. 3 as they have in FIG. 2.

In FIG. 3, starting from the position of FIG. 2, the user has employed the hand grip 28 to move the top of the bed 26 52 54 as indicated by the arcuate arrow 62 from a vertical position (as shown in FIG. 2) to a horizontal position (as shown in FIG. 3) thereby opening the sofa bed assembly 10.

As a bed base 26 moves progressively from the vertical position of FIG. 2 to the horizontal position of FIG. 3, rotation is achieved on the bearing mount assembly 50 which is attached to the edge of the first sidewall 14 (not shown in FIG. 3 to allow vision of other elements).

As the bed base 26 has moved progressively towards the horizontal position, so the armrest 36 has moved from a horizontal to a vertical position until its distal end rests upon the floor 22 providing a first support proximate to a first end for the bed 26 52 54. The rotated armrest 36 acts, at the end of the bed base 36 nearest to the carcass, as a proximal bed support.

As the bed base 26 has moved progressively towards the horizontal position shown in FIG. 3, so the leg supports 44 have pivoted about their proximal ends to maintain their vertical position eventually, as shown in FIG. 3, contacting the floor 22 with their shelf 46 horizontal upon the floor 22. The leg supports 44 and the shelf 46 thereby form a support for the bed 26 52 54 proximate to a second end of the bed 26 52 54. The rotatable leg supports 44 act, at the end of the bed base 26 furthest from the carcass 12, as a distal bed support.

As the bed 26 52 54 progresses from the vertical position of FIG. 2 to the horizontal position of FIG. 3 so the gas struts 42 on either side are progressively compressed, thereby serving progressively to support the weight of the bed 26 52 54 as it approaches the horizontal. The gas struts 42 container a spring element whose delivered force when the bed 26 52 54 is open is sufficient to prevent a user from being overwhelmed by the weight of the bed 26 52 54 but is not so great as to prevent the bed 26 52 54 from achieving the horizontal position shown in FIG. 3. When it comes to closing the bed 26 52 54 once more, the spring element has sufficient force to assist the user, employing the hand grip 28, readily to restore the bed 26 52 54 to the vertical position of FIG. 3.

As the bed 26 52 54 progresses from the vertical position of FIG. 2 to the horizontal position of FIG. 3, so the sofa back 34, attached to the bed base 26, rotates on the bearing mount assembly 50 to abut the sofa cushion 32 resting upon the sofa base 30. The folded sofa 34 32 30 thus forms further support proximate to the first end of the bed 26 52 54.

Figure 4:
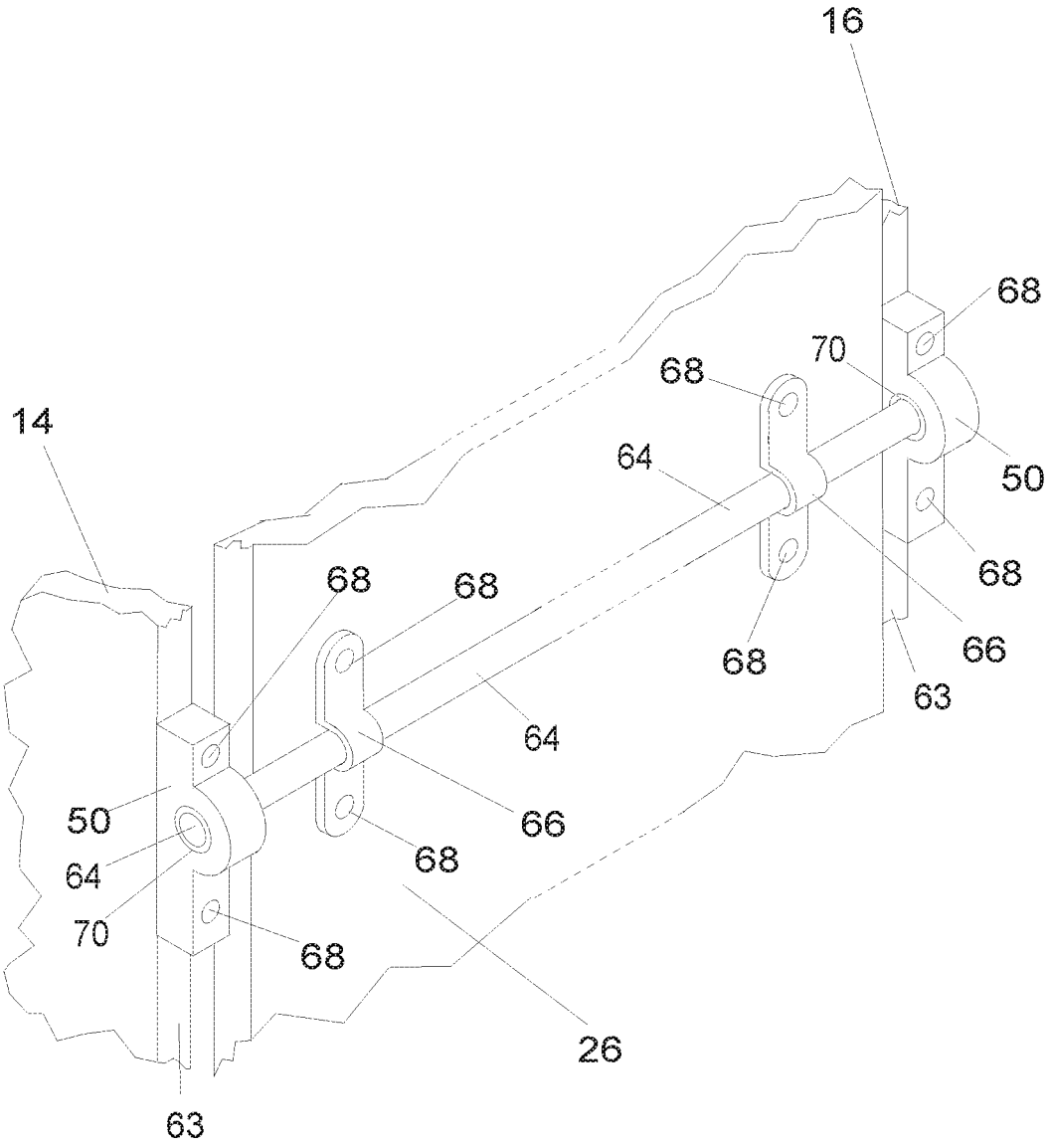
FIG. 4 is an oblique view showing, in more detail, the manner in which the bed base rotates on the bearing mount assembly.

Attention is next drawn to FIG. 4, an oblique view showing, in more detail, the manner in which the bed base 26 rotates on the bearing mount assembly 50.

A pair of bearing mount assemblies 50 are provided one on each of the first sidewall edge 14 of the carcass 12 at the edge remote from the wall 24 and the second sidewall edge 16 of the carcass 12 also at the edge remote from the wall 24. A steel rod 64 spans the distance between the pair of bearing mount assembly 50 and is attached to the bed base 26 by two or more spaced rod securing brackets 66. Screws or bolts 68 secure the bearing mount assemblies 50 and the rod securing brackets 66. The rod securing brackets preferably secure the steel rod 64 to be immovably held against the bed base 26. Each bearing mount assembly 50 has a cylindrical bearing 70 held there in. The steel rod 64 is firmly held in one part of the bearing and is free to rotate with low friction in the bearing mount assembly 50.

It is to be understood that the bearing 70 may equally be replaced by any other forms of bearing, including but not limited to: plain bearings, journal bearings, sleeve bearings, and concert bearings. In its simplest form, it may be a securing bracket 66 wherein the steel rod 64 is not held sufficiently securely to prevent its rotation.

It is also to be understood that the steel bar can be replaced by a steel pipe and, indeed, by any material which is strong enough to perform the required job of supporting a rotating bed base 26.

When the sofa bed is assembled and closed, as, for example, shown in FIG. 1, the steel rod 64 and the rod securing brackets 66 are concealed from view by the sofa cushion 32 and sofa back 34 which also cushion the steel rod 64 and a rod securing brackets 66 from causing discomfort when a user is sitting.

Figure 5:
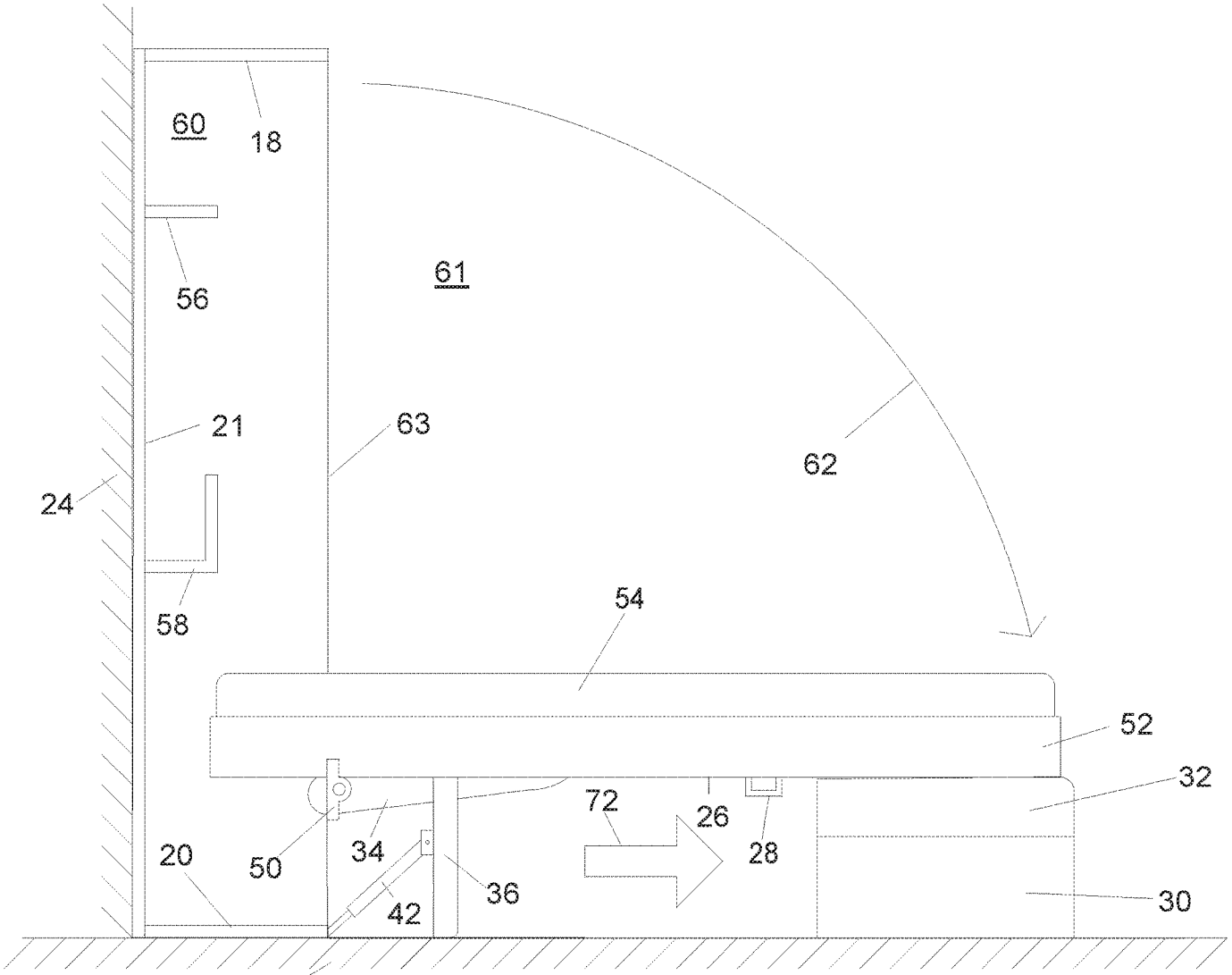
FIG. 5 shows an opening sofa bed according to a second embodiment of the invention.

Attention is next drawn to FIG. 5 showing a second embodiment for the invention.

FIG. 5 relates to a very similar sequence of events as are illustrated and described in relation to FIG. 3 The sofa bed assembly 10 of FIG. 5 does not comprise leg supports 44 and the associated shelf 46. A user, intent upon moving the bed 26 52 25 to the open position, first moves the sofa base 30 with its sofa cushion 32 affixed to the top thereof, as indicated by the shift arrow 72, to a position where the distal end of the bed 26 52 54 will rest thereon when the bed 26 52 54 is horizontal. The user then lowers the bed 26 52 54 as indicated by the arcuate arrow 62 from the vertical closed position to the horizontal open position. The hand grip 28 is positioned further down the bed base 26 to avoid damaging the sofa cushion 32. The moved sofa base 30 acts as an alternative distal bed support. If When moving the sofa bed assembly 10 of FIG. 5 back to the closed position, the user simply returns the bed 26 52 54 back to the vertical by movement opposing the arcuate arrow 62 and then pushes the sofa base and sofa cushion combination back under the sofa back 34. The sofa base 30 can be provided with wheels or casters to make such movements easier to achieve.

FIG. 5 thus shows an alternative method for opening the sofa bed where the armrests 36 form a first, sole proximate head support for the open bed 26 52 54 proximate to the first end of the bed 26 52 54 and the sofa base and sofa cushion combination form a second distal bed if support for the open bed 26 52 54 proximate to the second end of the bed.

If

Attention is next drawn to FIG. 6, showing an improvement which can be applied to both the first embodiment and to the second embodiment of the invention.

FIG. 6 shows the view of FIG. 2, and like items in FIGS. 6 and 2 have like names and numbers.

FIG. 6, shows an armrest extension 74 pivoting about an armrest extension pivot 76 at the distal end of the armrests 36. The armrest extension 74, in the position shown in FIG. 6, provides an extension to the armrest 36 having rotated as the sofa bed assembly 10 is moved to the closed position as indicated by armrest extension pivot arrow 78. The armrest extension 74 is prevented from falling beyond the position shown in FIG. 6 by the structure of the carpentry joint between it and the distal end of the armrest 36.

Attention is next drawn to FIG. 7, showing the improvement of FIG. 6 with the sofa bed assembly 10 in the open position.

Figure shows the view of FIG. 3, and like items in FIGS. 7 and 3 have liked names and numbers. As the sofa bed assembly 10 rotates into the open position, so the tip of the armrest extension 74 engages the floor 22. As the bed base 26 moves to the horizontal position, the armrest extension 74 rotates about the armrest extension pivot 76 until the armrest 36 rests vertically upon the floor 22 and the armrest extension 74 is rotated through 90° from the position shown in FIG. 6 to lie horizontally upon the floor 22.

The improvement shown in FIGS. 6 and 7 avoids the conflict between the overall length of the armrest 36 74 as experience by an individual sitting upon the sofa when the sofa bed assembly 10 is in the closed position, and the length of the armrest 36 required to act as a support for the bed above the floor 22. The arrangement shown in FIGS. 6 and 7 permits a comfortable arm support for seated individual and, at the same time, a correct armrest 36 length properly to support the bed base 30 above the floor 22 when in the open position.

The armrest shields 38, in the arrangement shown in FIGS. 6 and 7, is arranged to accommodate gas struts.

Those skilled in the art will be aware of many variants and modifications that may be applied without deviating from the invention as claimed hereafter.

The invention claimed is:

1. A sofa bed comprising:

a carcass having first and second sidewalls and top and bottom panels, the carcass providing an inside and an outside, and also providing an interface between the inside and the outside;

a bed base, rotatable to lie coplanar with the interface when the bed is in the closed position and at a right angle to the interface coplanar with a floor when the bed is in an open position;

a sofa base and a sofa back disposed to enable a person to sit thereon when the bed is in a closed position and foldable against one another beneath the bed base when the bed is in an open position;

where the bed base comprises an armrest for a seated person to rest their arm when the bed is in a closed position and where the armrest acts as a proximal bed support at the end of the bed base closest to the carcass when the bed is in the open position;

where the sofa bed comprises a distal bed support for the bed base at the end of the bed base furthest from the carcass, the distal bed support being transformable to a support function as the bed base is moved to an open position;

where the sofa bed comprises a gas strut fixable at a first end to the armrest and at a second end to the floor, the gas strut lying outside of the carcass, such that the gas strut is uncompressed when the bed is in the closed position and compressed when the bed is in the open position;

where the bed base comprises at least one of:

a shelf, rotatable under gravity relative to the bed base when the bed is moved to an open position to act as said distal bed support;

and a sofa base, movable from its position as a component of the sofa as the bed is lowered into the open position to position where the sofa base is operable to act as said distal bed support.

2. A sofa bed according to claim 1 comprising first and second horizontally spaced rotatable mount assemblies operable to support the bed base for rotation between a vertical and a horizontal position, the first and second mount assemblies being attached to the outside of the carcass at the interface.

3. A sofa bed according to claim 1 wherein the armrest is provided with an armrest extension, rotatable as the bed is raised into the closed position to provide an extension to the armrest for use by a person sitting upon the sofa; the armrest extension being operable as the bed is lowered to the open position to engage the floor to swing at 90° to the armrest to allow the armrest to act as a support for the bed against the floor.

4. A sofa bed according to claim 3 further comprising an armrest shield for each armrest covering the armrest, the mount assembly and the gas strut and able to accommodate movement thereof as the bed base moves between a vertical closed position to a horizontal open position.

5. A sofa bed according claim 4 further comprising a mattress and bed base sidewalls; the bed base sidewalls holding the mattress atop the bed base when the sofa bed is in the open position; and the bed base sidewalls holding the mattress within the carcass, when the bed base is in the closed vertical position within the carcass.

6. A sofa bed according claim 1 further comprising a mattress and bed base sidewalls; the bed base sidewalls holding the mattress atop the bed base when the sofa bed is in the open position; and the bed base sidewalls holding the mattress within the carcass, when the bed base is in the closed vertical position within the carcass.

7. A sofa bed according to claim 5 further comprising one or more storage locations within the carcass.

8. A sofa bed according to claim 1 further comprising one or more storage locations within the carcass.

* * * * *